US006527624B1

(12) United States Patent
Tolles et al.

(10) Patent No.: US 6,527,624 B1
(45) Date of Patent: Mar. 4, 2003

(54) CARRIER HEAD FOR PROVIDING A POLISHING SLURRY

(75) Inventors: Robert D. Tolles, Santa Clara; Sidney Huey, Oakland, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/421,453

(22) Filed: Oct. 19, 1999

Related U.S. Application Data

(63) Continuation-in-part of application No. 09/276,853, filed on Mar. 26, 1999.

(60) Provisional application No. 60/143,060, filed on Jul. 9, 1999.

(51) Int. Cl.[7] ..... B24B 1/00; B24B 5/00; B24B 41/06; B24B 57/00

(52) U.S. Cl. ..... 451/41; 451/56; 451/60; 451/285; 451/286; 451/287; 451/384; 451/446

(58) Field of Search ..... 451/41, 56, 384, 451/385, 446, 285–289, 60

(56) References Cited

U.S. PATENT DOCUMENTS

| | | | | |
|---|---|---|---|---|
| 5,205,082 A | | 4/1993 | Shendon et al. | |
| 5,664,990 A | | 9/1997 | Adams et al. | |
| 5,695,392 A | * | 12/1997 | Kim | 451/41 |
| 5,709,593 A | | 1/1998 | Guthrie et al. | |
| 5,851,140 A | | 12/1998 | Barns et al. | |
| 5,902,173 A | * | 5/1999 | Tanaka | 451/41 |
| 5,931,725 A | | 8/1999 | Inaba et al. | |
| 5,944,582 A | | 8/1999 | Talieh | |
| 5,944,593 A | * | 8/1999 | Chiu et al. | 451/442 |
| 6,007,411 A | * | 12/1999 | Feeney | 451/41 |
| 6,086,454 A | | 7/2000 | Watanabe et al. | |
| 6,110,012 A | | 8/2000 | Maury et al. | |
| 6,179,694 B1 | * | 1/2001 | Quek | 451/41 |

FOREIGN PATENT DOCUMENTS

EP 0 841 123 5/1998

OTHER PUBLICATIONS

U.S. patent application Ser. No. 09/276,853, filed Mar. 26, 1999, entitled A Carrier Head for Providing a Polishing Slurry in a Chemical Mechanical Polishing Apparatus.

U.S. patent application Ser. No. 60/143,060, filed Jul. 9, 1999, entitled Direct Feed Slurry Delivery System.

* cited by examiner

*Primary Examiner*—M. Rachuba
(74) *Attorney, Agent, or Firm*—Fish & Richardson

(57) ABSTRACT

A carrier head of a chemical mechanical polishing apparatus to apply and distribute a polishing slurry to a polishing pad. The retaining ring includes a trough and one or more channels to channel the polishing slurry to the polishing pad.

30 Claims, 9 Drawing Sheets

CARRIER HEAD FOR PROVIDING A POLISHING SLURRY

CROSS-REFERENCE TO RELATED APPLICATIONS

This is a continuation-in-part of U.S. application Ser. No. 09/276,853, filed Mar. 26, 1999, the entire disclosure of which is incorporated herein by reference. This application also claims priority to provisional U.S. application Ser. No. 60/143,060, filed Jul. 9, 1999.

BACKGROUND

The present invention relates generally to chemical mechanical polishing of substrates, and more particularly to a carrier head for use in chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head, and pressed against a rotating polishing pad. The polishing pad may comprise an abrasive surface. An abrasive chemical solution or slurry may be introduced onto the polishing pad to assist the polishing process. The slurry should be distributed in a substantially uniform layer across the polishing pad. This improves the uniformity of planarization.

SUMMARY

In one aspect, the invention is directed to a carrier head for a chemical mechanical polishing apparatus. The carrier head has a substrate receiving surface, a retaining ring surrounding the substrate receiving surface, and a slurry reservoir formed on the carrier head. The reservoir is in fluid communication with a bottom surface of the retaining ring to direct a polishing slurry from the reservoir to a polishing pad.

Implementations of the invention may include the following features. The reservoir may be formed in an upper surface of a housing the carrier head, in a top surface of a slurry supply member that surrounds the retaining ring, or in a top surface of the retaining ring. A passage may be formed through the housing, the retaining ring and/or the slurry supply member. The slurry may be directed from the reservoir to a bottom surface of the retaining ring or to a bottom surface of the slurry supply member. A channel may be formed in the bottom surface of the retaining ring or the slurry supply member to direct slurry inwardly.

In another aspect, the invention is directed to a retaining ring for a carrier head. The retaining ring has an annular body having an inner surface to retain a substrate, a trough in an upper surface of the retaining ring, and a plurality of channels extending through the retaining ring from the trough to a lower surface of the retaining ring.

Implementations of the invention may include the following features. Each channel can terminates in a groove in the lower surface of the retaining ring. A lip in the trough can retain the slurry in the trough as the retaining ring rotates.

In another aspect, the invention is directed to a carrier head for chemical mechanical polishing that has a substrate receiving surface, a retaining ring surrounding the substrate receiving surface, and at least one channel through the retaining ring to fluidly couple a trough in the carrier head to a bottom surface of the retaining ring to dispense a polishing slurry on a polishing pad.

Implementations of the invention may include the following features. There may be a plurality of channels. The trough may include a lip to contain the polishing slurry as the carrier head is rotated. The polishing slurry may be metered into the trough at a rate in the range of about 25–100 ml/min, or gravity fed into the trough at a rate in the range of about 25–100 ml/min. A tube may connect a passage in a carrier head drive shaft to the trough. An inwardly extending groove may be formed in the bottom surface of the retaining ring carry and fluidly coupled to the at least one passage. A circular groove may be formed in the bottom surface of the retaining ring carry and fluidly coupled to the at least one passage.

In another aspect, the invention is directed to a chemical mechanical polishing apparatus. The apparatus has a polishing pad and a carrier head. The carrier head includes a substrate receiving surface, a retaining ring surrounding the substrate receiving surface, a trough on a top surface of the retaining ring, and at least one channel to fluidly couple the trough to a bottom surface of the retaining ring to dispense a polishing slurry on a polishing pad. An arm extends over the polishing pad to dispense a polishing slurry into the trough.

Implementations of the invention may include the following features. The arm may be pivotally connected to a machine base.

In another aspect, the invention may be directed to a method for a chemical mechanical polishing apparatus. In the method, a polishing slurry is directed through a passage in a retaining ring onto a polishing pad.

Implementations of the invention may include the following features. Polishing slurry may be dispensed into a trough on the retaining ring which is in fluid communication with the passage. The polishing slurry may be dispensed continuously, e.g., at a rate in the range of about 25–100 ml/min, or intermittently, e.g. with a sufficient slurry to polish a preselected number of substrates.

The present invention advantageously provides slurry to an area near the interface between a substrate and a polishing pad. The slurry-containing trough evenly and uniformly distributes the slurry on the polishing pad. Due to such distribution of the slurry, the CMP apparatus will planarize substrates more uniformly, imparting the attendant benefits of improved planarization. The invention also advantageously conserves the amount of polishing slurry used. Polishing slurry is an expensive consumable, and it is conserved by applying it to the substrate/polishing pad interface, rather than over the entire pad surface. By reducing the amount of slurry applied to the pad, the CMP apparatus is more likely to remain relatively clean and free of dried slurry, thereby reducing the likelihood of damage to the substrate.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein.

Like reference numbers are designated in the various drawings to indicate like elements. A reference number primed indicates that an element has a modified function, operation or structure.

DETAILED DESCRIPTION

Figure 1:
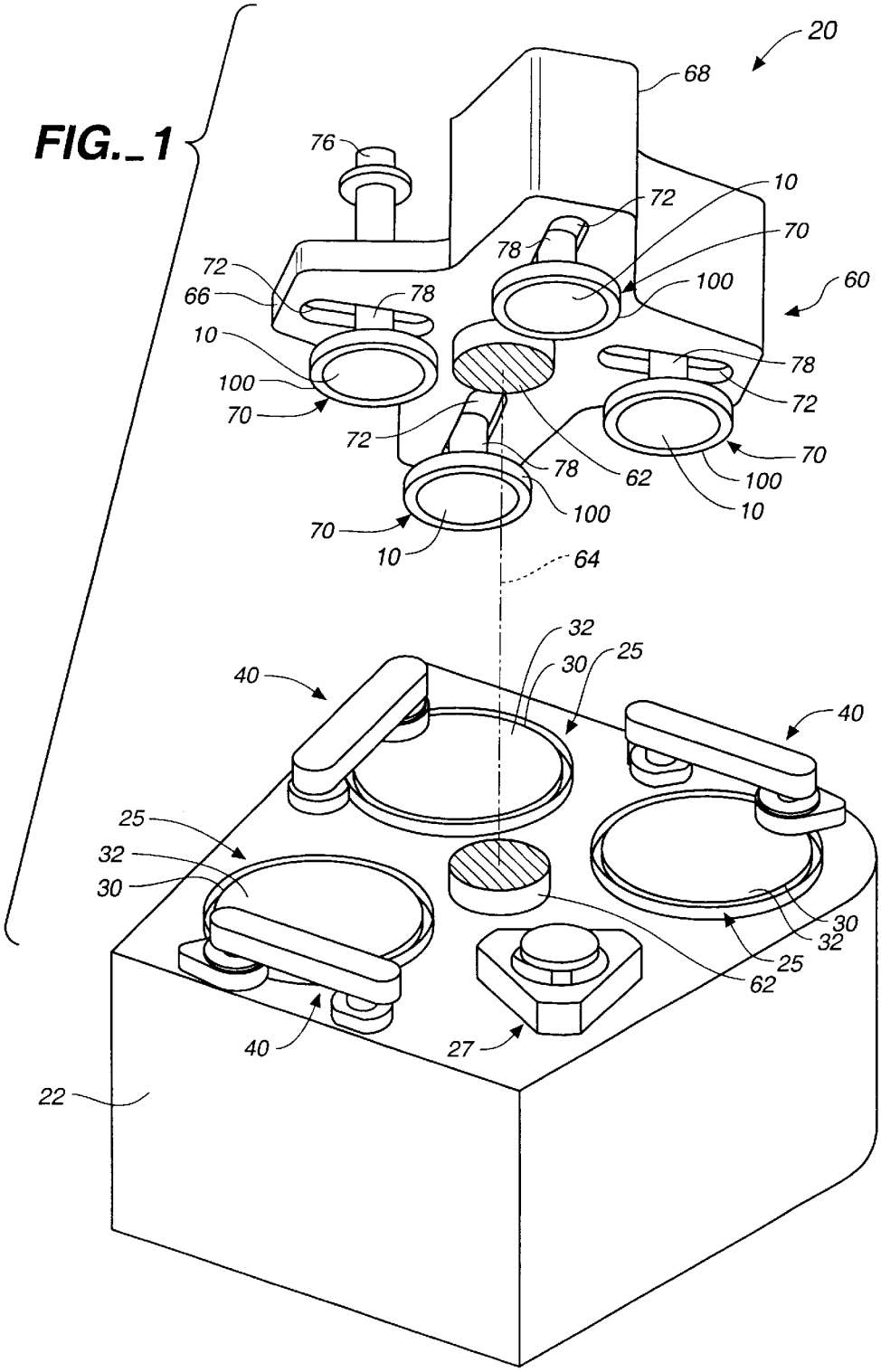
FIG. 1 is an exploded perspective view of a chemical mechanical polishing apparatus.

As shown in FIG. 1, a substrate 10 is polished by a chemical mechanical polishing (CMP) apparatus 20. A description of a similar CMP apparatus may be found in U.S. Patent No. 5,738,574, the entire disclosure of which is incorporated herein by reference. The CMP apparatus 20 includes a machine base 22 that supports three polishing stations 25 and a transfer station 27. Each polishing station includes a rotatable platen 30 on which is placed a polishing pad 32. Each polishing station 25 may further include a corresponding pad conditioner device 34 to maintain the abrasive condition of the polishing pad 32.

The CMP apparatus also includes a rotatable multi-head carousel 60 that supports four carrier head systems 70. The carousel 60 can rotate to orbit the carrier head systems 70, and the substrates 10 attached thereto, between the polishing stations 25 and the transfer station 27. Each carrier head system includes a polishing or carrier head 100. Each carrier head 100 independently rotates about its own axis. Each carrier head 100 also independently and laterally oscillates in a radial slot 72 formed in a carousel support plate 66. A carrier drive shaft 78 extends through the slot 72 connecting a carrier head rotation motor 76 (shown by the removal of one-quarter of a cover 68) to the carrier head 100. The motor 76 and drive shaft 78 may be supported on a slider (not shown) that is linearly driven along the slot 72 by a radial drive motor (not shown) to laterally oscillate the carrier head 100.

Figure 2:
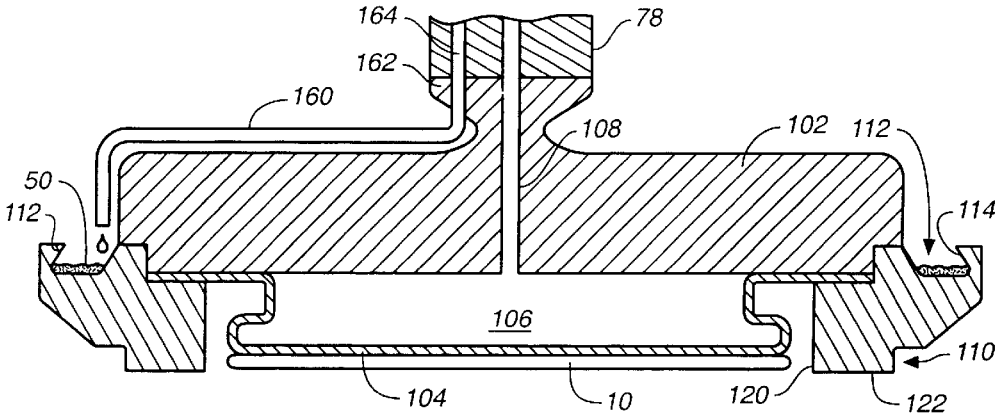
FIG. 2 is a cross-sectional view of an exemplary carrier head having an external feed line and retaining ring with a slurry-containing trough.
Figure 3:
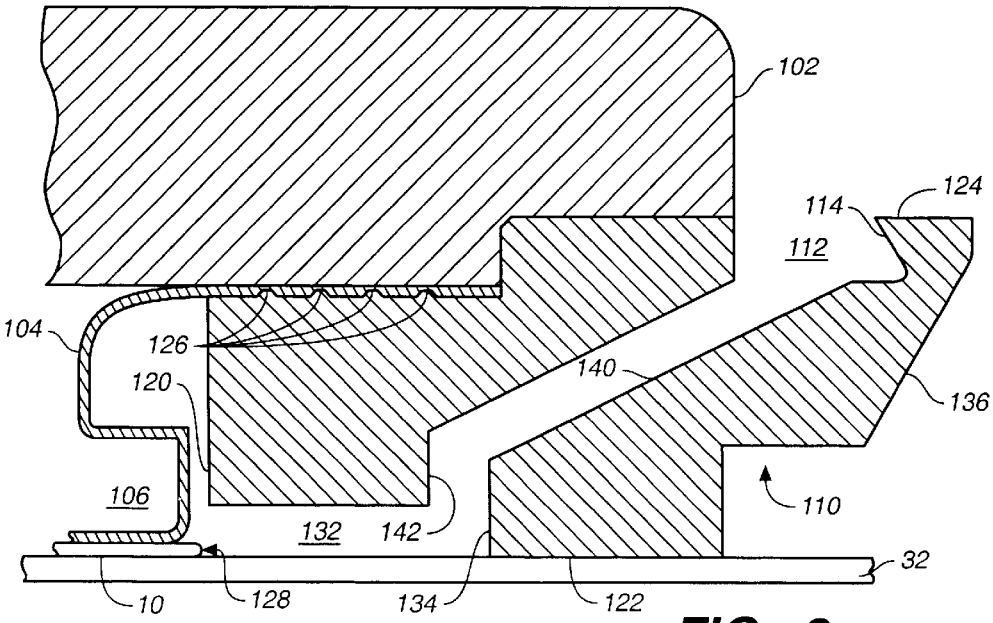
FIG. 3 is an expanded view illustrating a passage through a retaining ring in the carrier head of FIG. 2.
Figure 4:
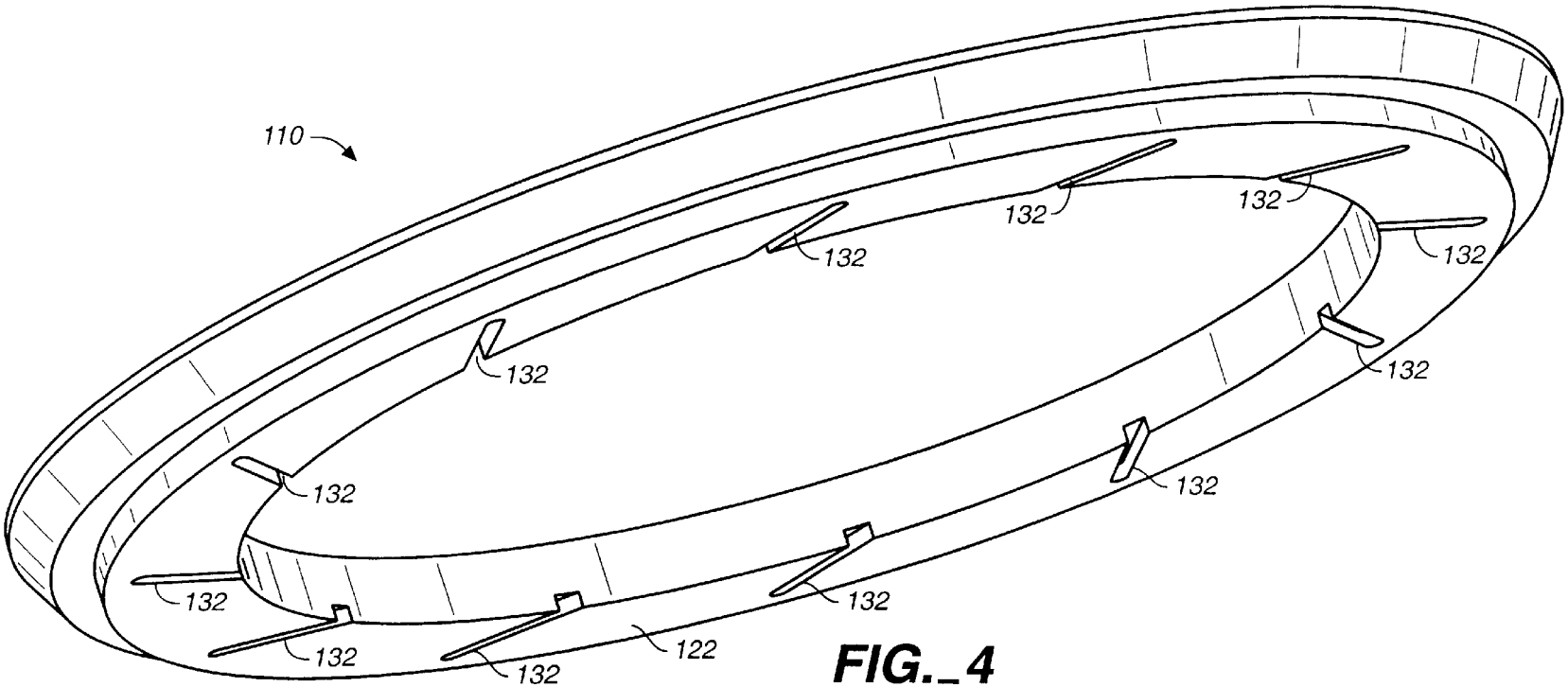
FIG. 4 is a bottom perspective view of the retaining ring of FIG. 3.
Figure 5:
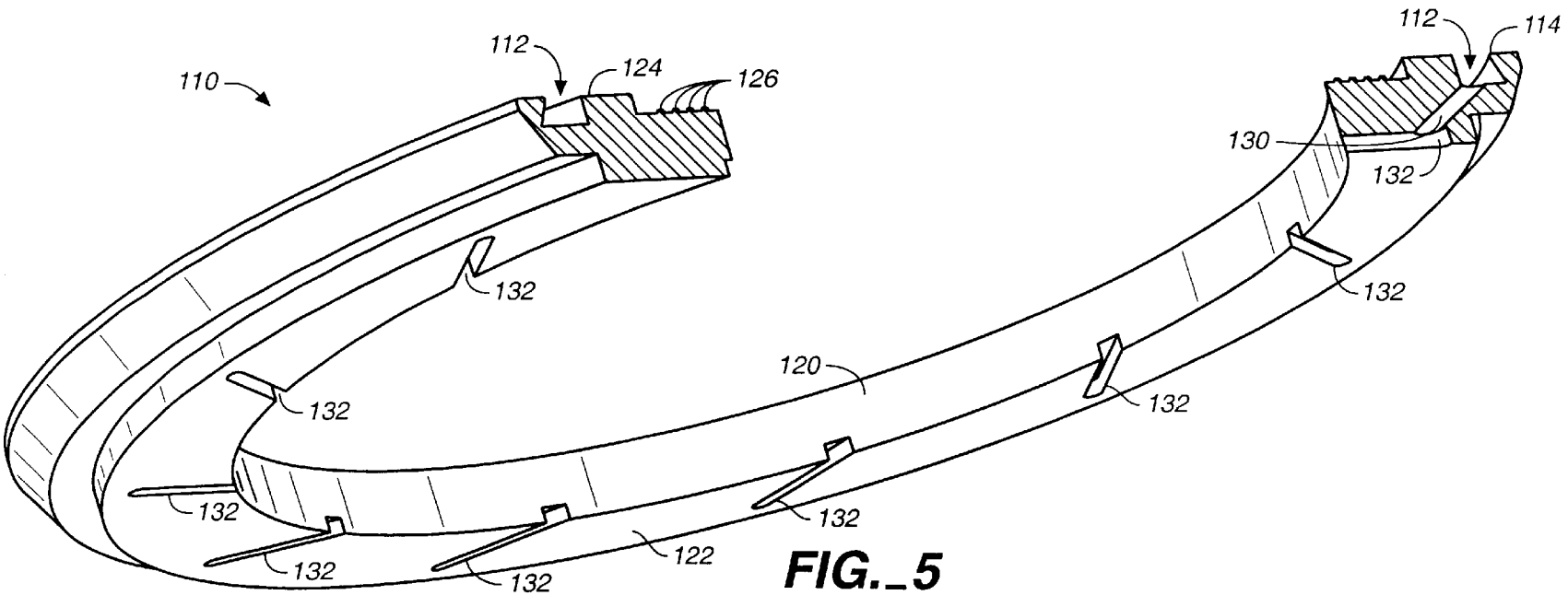
FIG. 5 is a bottom perspective view, partially cut-away, of the retaining ring of FIG. 3.
Figure 6:
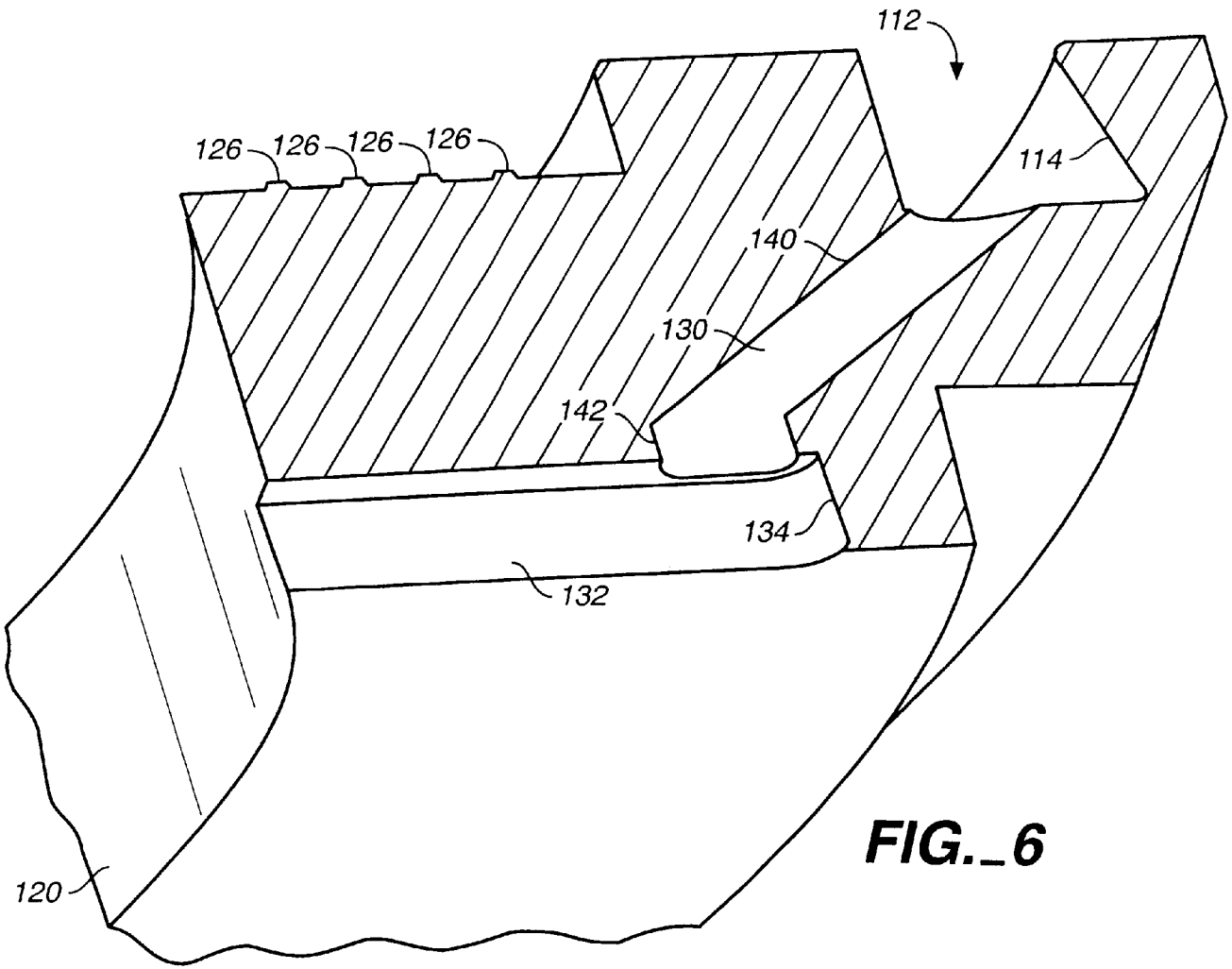
FIG. 6 is an expanded view of the cut away portion of FIG. 5.

As shown in FIG. 2, the carrier head 100 can include a housing or base 102 and a flexible membrane 104 clamped to the housing 102 to form a loading chamber 106. The housing 102 is connected to the drive shaft 78, and may be generally circular in shape to correspond to the circular configuration of the substrate 10. Fluid may be injected into the loading chamber 106 through a passage 108 in the housing 102 to pressurize the loading chamber 106 and apply a load (i.e., a downward pressure) to the substrate. A discussion of a similar carrier head is found in U.S. patent application Ser. No. 08/861,260, entitled "A Carrier Head With A Flexible Membrane for a Chemical Mechanical Polishing System," which is assigned to the assignee of the present invention, the entire disclosure of which is incorporated herein by reference.

Referring to FIGS. 2–6, the carrier head 100 also includes a retaining ring 110 that may be secured at the outer edge of the housing 102, e.g., by bolts (not shown).

The retaining ring 110 has an inner surface 120 to engage the substrate 10 and prevent the substrate from slipping or sliding from beneath the carrier head 100 during polishing, and a bottom surface 122 which can contact and compress the polishing pad. Other than the area where channels 132 are present, the bottom surface 122 of the retaining ring 110 may be substantially flat (see FIG. 4). An upper surface 124 of the retaining ring 110 includes circumferential ribs 126 that engage a flexible membrane that is used to transfer pressure to the substrate 10.

A portion of the upper surface 124 of the retaining ring which projects outwardly beyond the housing 102 has a trough 112 to hold slurry. The slurry trough 112 may be an annular depression extending entirely around the carrier head. The slurry trough 112 includes an inwardly-angled lip 114 for containing the slurry as the carrier head rotates. The lip 114 is angled inward toward the axis of rotation of the carrier head to prevent centrifugal forces from causing the slurry the spill over the trough. A plurality of passages 130, e.g., three to twelve passages, are formed through the retaining ring 110 to fluidly couples the trough 112 to the bottom surface 122 of the retaining ring 110. Specifically, gravity causes the polishing slurry in the trough 112 to drain through the passages 130 and accumulate on the polishing pad surface. In one implementation, each passage 130 can include a generally diagonal portion 140 and a generally vertical portion 142. The retaining ring may be constructed of a polyphenyl sulfide, stainless steel or some combination thereof, and the passages 130 may be formed by precision machining.

The angle $\phi$ and the diameter D of diagonal passage 140 determines the available volume for the slurry reservoir, and also determines the speed at which the reservoir will drain. The angle $\phi$ should be about 5° to 60°, and the diameter D should be smaller than the typical groove width, e.g., about 0.015 to 0.040 inches.

Assuming the passage is angled inwardly from top to bottom, with a large angle $\phi$, centrifugal forces will tend to prevent the slurry from flowing through the passage, thereby decreasing the slurry delivery rate. The diameter of the passage also needs to be carefully controlled to ensure that slurry does not flow out of the trough 112 too quickly. Increasing the passage diameter will increase the slurry flow rate, whereas decreasing the passage diameter will reduce the slurry flow rate.

An optional channel 132 may be formed in the bottom surface 122 for each passage 130. Each channel 132 extends from the lower extremity of the associated passage 130 to the inner surface 120 of the retaining ring 110. The channel 132 also includes a back wall 134 to prevent centrifugal forces from expelling the slurry from beneath the carrier head 100. The channels 132 assist the flow of the slurry to the pad-substrate interface.

The trough 112 is open to the atmosphere, and may be fed a polishing slurry 50 by an external feed tube 160. In one implementation, the feed tube 160 is secured to the housing 102. For example, the feed tube 160 may extend through a housing flange 162 to be connected to a passage 164 through the drive shaft 78. The slurry 50 may be metered through the feed tube 160 by a metering pump (not shown) that is located in the carousel 60. The slurry may be metered at a rate of about 25–100 ml/min., e.g., 75–100 ml/min., to replace slurry that is consumed during polishing. The slurry 50 is dispensed into the trough 112, and passes through the passage 130 to an area defined by the horizontal channel 132. In that area, the slurry 50 is applied to the polishing pad and distributed to the interface 128 between the polishing pad and the substrate.

The slurry 50 may contain a reactive agent (e.g., deionized water for oxide polishing) and a chemically-reactive catalyzer (e.g., potassium hydroxide for oxide polishing). Where the polishing pad 32 is a standard pad, the slurry 50 may include abrasive particles, such as silicon dioxide for oxide polishing in the form of colloidal silica or fumed silica.

Figure 7:
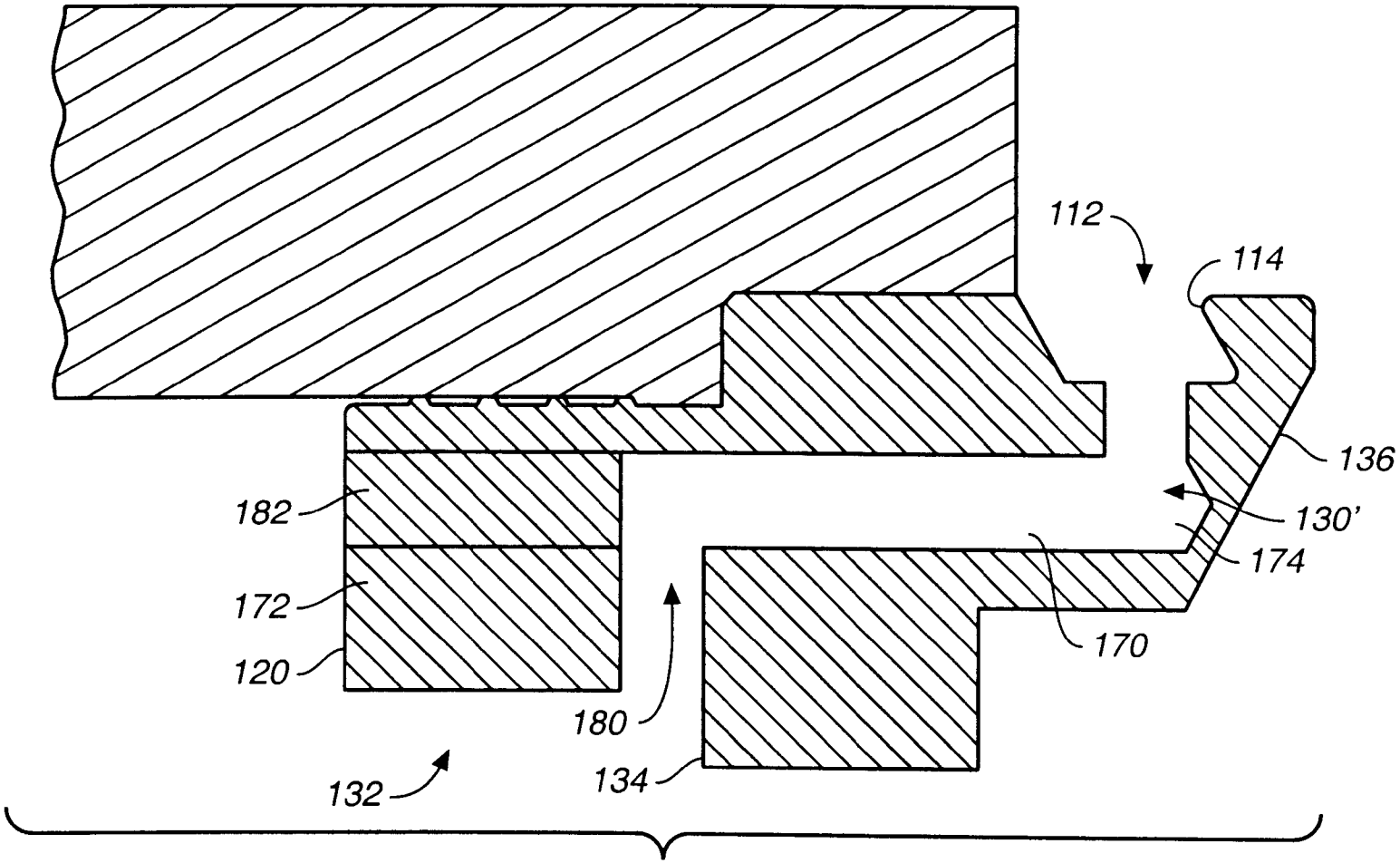
FIG. 7 is a cross-sectional view of another implementation of a retaining ring with a slurry-containing trough.

In another implementation, illustrated in FIG. 7, the path of the passage 130' is zig-zag in shape between the upper and lower surfaces of the retaining ring. The passages 130' may be formed by machining an upper horizontal hole 170 from the inner diameter wall 120 of the retaining ring to the trough 112. The horizontal hole 170 is machined from the inner wall 120 to a point 174 short of an outer diameter wall 136 of the retaining ring beneath trough 112. To connect the horizontal hole 170 to the channel 132, a vertical hole 180 is machined from the back wall 134 of the channel 132 to the horizontal hole 170. The passage 130' is completed by plugging an inner radial portion 182 of the horizontal hole 170 with a suitable material, such as a metal. Naturally, many other implementations and configurations of the passage are possible. For example, the passage could be a straight diagonal or vertical segment. The diagonal portion of the passage can be angled inwardly or outwardly.

Figure 8A:
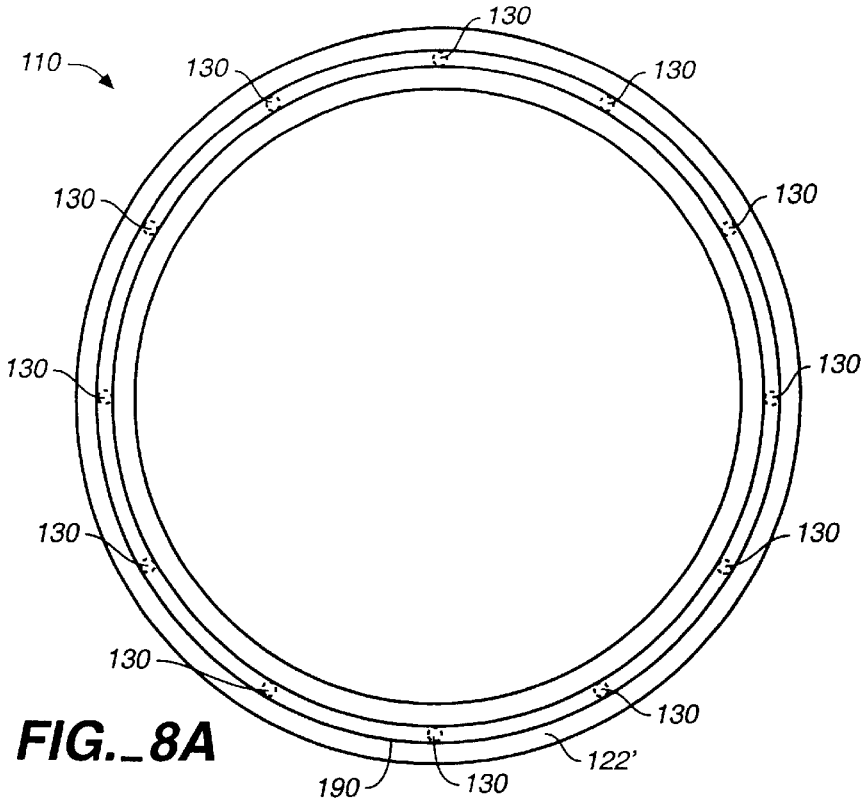
FIGS. 8A and 8B are bottom and cross-sectional side views of another implementation of a retaining ring with an annular groove on its bottom surface.
Figure 8B:
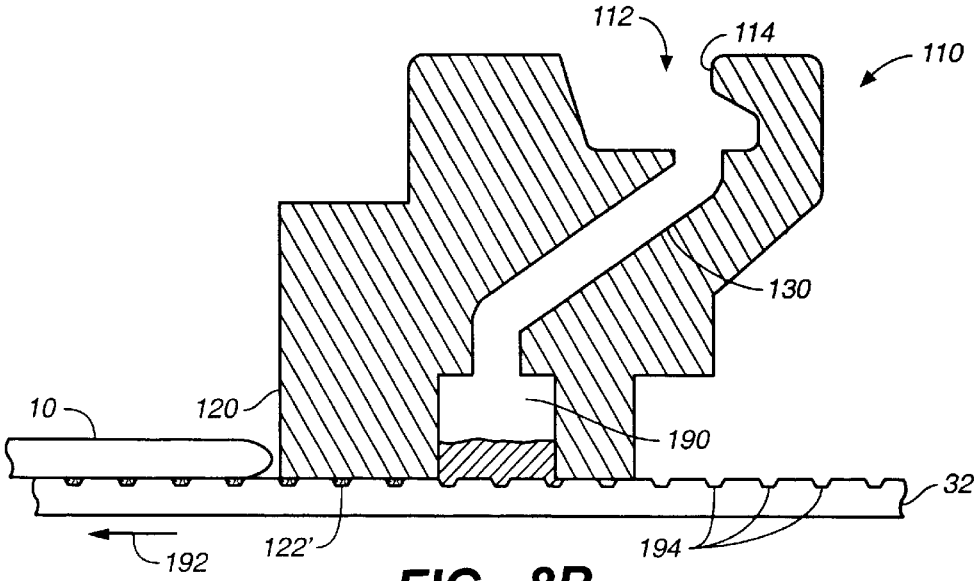

Referring to FIGS. 8A and 8B, in another embodiment, the retaining ring does not include channels 132. Instead, a circular groove 190 formed in the bottom surface 122 of the retaining ring is fluidly coupled to the passages 130. A small reservoir of slurry accumulates in the groove 190. As the polishing pad passes beneath the carrier head in the direction indicated by arrow 192, perforations or grooves 194 in the polishing pad 32 are filled with slurry. Slurry is carried in the perforations or grooves beneath the retaining ring and the substrate as the polishing pad rotates. It may be noted that the size and shape of the perforations or grooves can influence the rate of flow of the slurry through the passages 130. Specifically, grooves can permit slurry to flow rapidly away from the region of contact between the retaining ring and the polishing pad. In contrast, perforations tend to carry away only the slurry that fills those perforations. Naturally, wider or deeper grooves or perforations will carry more slurry than narrow or shallow grooves or perforations.

Figure 9A:
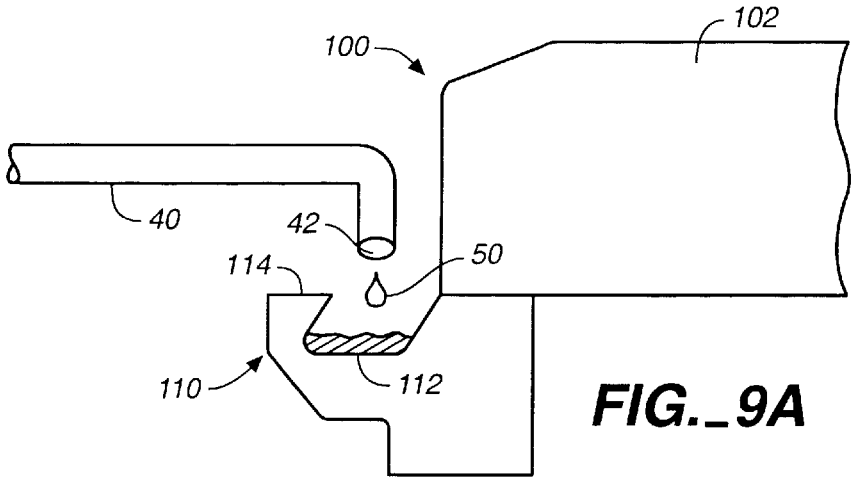
FIGS. 9A and 9B are side schematic and top views, respectively, of a slurry delivery arm which can deliver slurry to a slurry trough on the carrier head.
Figure 9B:
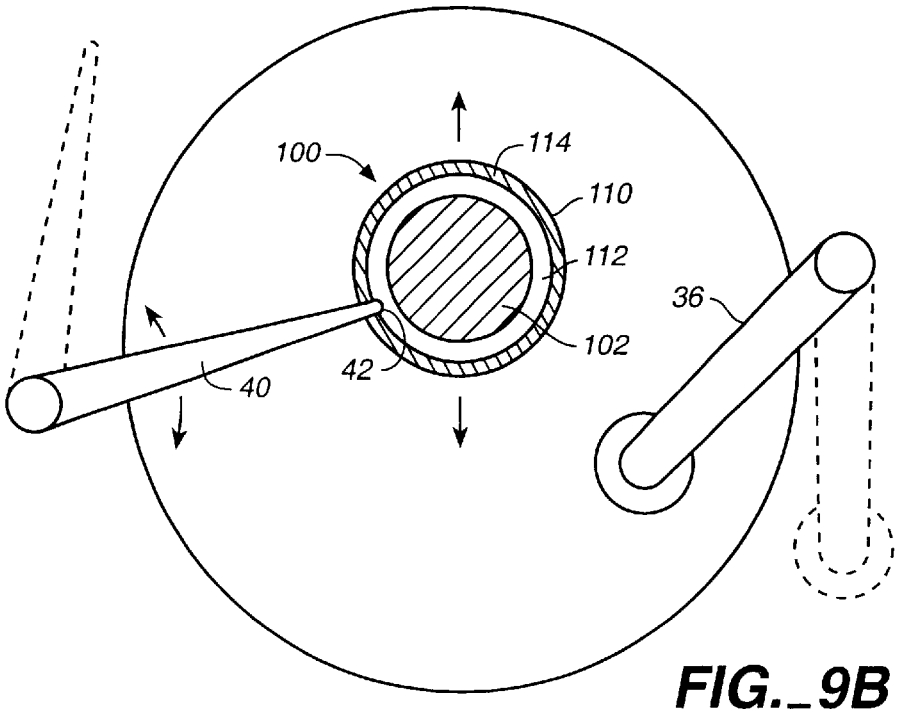

As shown in FIGS. 9A and 9B, in another implementation, slurry may be fed into the trough 112 by a slurry delivery arm 40 that extends over the surface of the polishing pad 32. The delivery arm 40 may be pivotally mounted on the machine base 22, and can be positioned so that the tube exit 42 (shown in FIG. 9A) dispenses slurry 50 directly into the trough 112. Slurry can be dispensed while the carrier head is stationary, or the pivoting motion of the arm 40 may be controlled to be coordinated with the oscillation of the carrier head by a central processing controller (not shown) to dispense slurry into the trough 112 as the carrier head 100 is oscillating. The delivery arm 40 may be swung away from the polishing pad when the slurry delivery operation is complete.

The slurry 50 may be metered through the delivery arm 40 by a metering pump (not shown) that may be located within the machine base 22. Slurry 50 can be dispensed into the trough on a continuous or intermittent basis. Assuming that the slurry is dispensed continuously, the flow rate of the dispensed slurry may be calculated from the slurry consumption rate. The flow rate may be slightly greater than the consumption rate to ensure that the polishing pad 32 remains covered slurry. For example, the slurry may be metered at a flow rate of about 25–100 ml/min., e.g., 75–100 ml/min. Alternatively, if the slurry is dispensed intermittently, sufficiently slurry may be dispensed into the trough 112 to polish a set number of substrates, e.g., one substrate. When the set number of substrate has been polished, the delivery arm 40 is moved into position and the slurry reservoir is refilled. This slurry dispensing system can be combined with any of the prior retaining ring configurations.

The delivery arm 40 may also be used to dispense a cleaning fluid, e.g., deionized water, into the trough 112. This can rinse slurry from the passages 130 to prevent the accumulation of dried slurry. The carrier head (or at least the retaining ring) may be lifted away from the polishing pad before the trough 112 is rinsed. By removing the barrier at the lower surface of the retaining ring defined by the polishing surface, the slurry in the trough will flow out of the passages 130 quickly, thus emptying the slurry from the trough.

Figure 10:
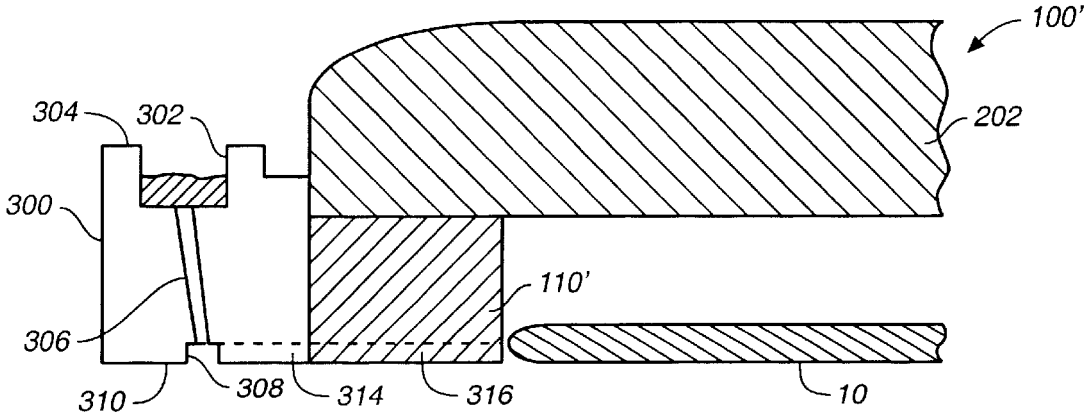
FIG. 10 is a cross-sectional view of a portion of a carrier head with an annular slurry supply member surrounding the retaining ring.

Referring to FIG. 10, in another embodiment, an annular slurry supply member 300 is attached to the carrier head 100' surrounding the retaining ring 110'. The slurry supply member includes a reservoir 302 formed in its top surface 304, and a passage 306 that extends generally vertically from the reservoir 302 to a channel 308 in a bottom surface 310 of the slurry supply member 300. Reservoir 302 holds a supply of slurry 312, which flows under the action of gravity through the channel 308 and onto the polishing pad. The volume of slurry stored in reservoir 302 should be sufficient for several minutes of polishing. A groove 314 (shown in phantom) may be formed in the bottom surface 310 and may fluidly communicate with a groove 316 (also shown in phantom) in the bottom surface of retaining ring 110' in order to carry slurry to the substrate 10.

Figure 11:
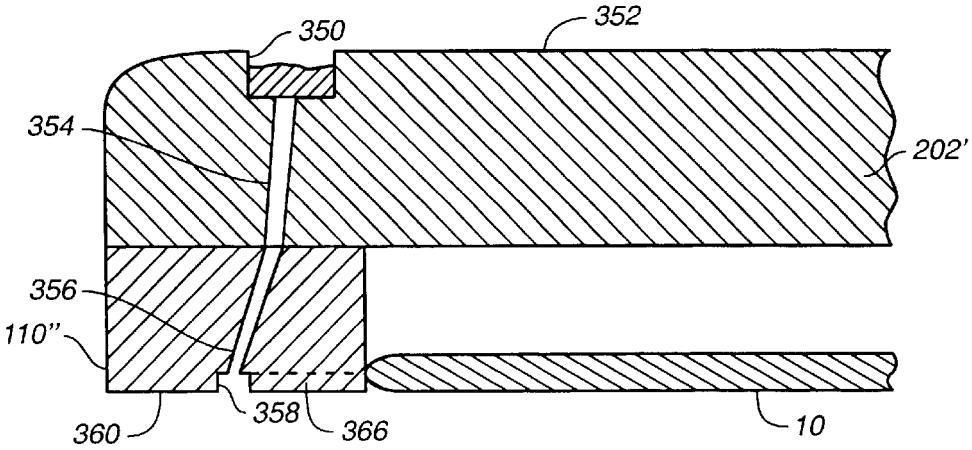
FIG. 11 is a cross-sectional view of a portion of a carrier head with a slurry supply reservoir formed in a top surface of a carrier housing.

Referring to FIG. 11, in yet another embodiment, a reservoir 350 is formed in a top surface 352 of the housing 202" of the carrier head 100". A passage 354 extends through the housing 202" to be fluidly coupled to a passage 356 in the retaining ring 110". The passages 354 and 356 connect the reservoir 350 to a channel 358 in the bottom surface 360 of the retaining ring 110'. Reservoir 350 holds a supply of slurry 362, which flows under the action of gravity through the passage 354 and onto the polishing pad. A groove 366 (shown in phantom) may be formed in the bottom surface of the retaining ring 110" in order to carry slurry to the substrate 10. An advantage of this embodiment is that the carrier head 100" has a smaller diameter than the carrier head 100'.

Thus, the present invention advantageously reduces the amount of slurry applied to the pad by providing slurry to an area proximate to the interface between the substrate and a rotating polishing pad. The invention also improves and enhances the planarization of the substrate, thus imparting the attendant benefits of improved planarization.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a substrate receiving surface;

a retaining ring having at least one channel extending through the retaining ring surrounding the substrate receiving surface; and a slurry reservoir formed on the carrier head, the reservoir in fluid communication with a bottom surface of the retaining ring via the channel in the retaining ring to direct a polishing slurry from the reservoir to a polishing pad.

2. The carrier head of claim 1, wherein the reservoir is formed in an upper surface of a housing the carrier head.

3. The carrier head of claim 2, wherein a passage is formed through the housing and the retaining ring to direct slurry from the reservoir to a bottom surface of the retaining ring.

4. The carrier head of claim 1, wherein the reservoir is formed in a top surface of a slurry supply member that surrounds the retaining ring.

5. The carrier head of claim 4, wherein a passage is formed through the slurry supply member to direct slurry from the reservoir to a bottom surface of the slurry supply member.

6. The carrier head of claim 4, wherein a channel is formed in the bottom surface of the slurry supply member to direct slurry inwardly to the retaining ring.

7. The carrier head of claim 1, wherein the reservoir is formed in a top surface of the retaining ring.

8. A carrier head for a chemical mechanical polishing apparatus, comprising:

a substrate receiving surface;

a retaining ring surrounding the substrate receiving surface; and a slurry reservoir formed on the carrier head, the reservoir in fluid communication with a bottom surface of the retaining ring to direct a polishing slurry from the reservoir to a polishing pad, wherein the reservoir is formed in a top surface of the retaining ring, wherein a passage is formed through the retaining ring to direct slurry from the reservoir to a bottom surface of the retaining ring and wherein a channel is formed in the bottom surface of the retaining ring to direct slurry inwardly to the substrate.

9. A carrier head for a chemical mechanical polishing apparatus, comprising:

a substrate receiving surface;

a retaining ring surrounding the substrate receiving surface; and a slurry reservoir formed on the carrier head, the reservoir in fluid communication with a bottom surface of the retaining ring to direct a polishing slurry from the reservoir to a polishing pad, wherein a channel is formed in the bottom surface of the retaining ring to direct slurry inwardly to the substrate.

10. A retaining ring for a carrier head, comprising:

an annular body having an inner surface to retain a substrate;

a trough in an upper surface of the retaining ring; and a plurality of channels extending through the retaining ring from the trough to a lower surface of the retaining ring.

11. The retaining ring of claim 10, wherein each channel terminates in a groove in the lower surface of the retaining ring.

12. The retaining ring of claim 10, further including a lip in the trough to retain the slurry in the trough as the retaining ring rotates.

13. A carrier head for chemical mechanical polishing, comprising:

a substrate receiving surface;

a retaining ring surrounding the substrate receiving surface; and at least one channel through the retaining ring to fluidly couple a trough in the carrier head to a bottom surface of the retaining ring to dispense a polishing slurry on a polishing pad.

14. The carrier head of claim 13, wherein there are a plurality of said channels.

15. The carrier head of claim 13, wherein the trough includes a lip to contain the polishing slurry as the carrier head is rotated.

16. The carrier head of claim 13, wherein the polishing slurry is metered into the trough at a rate in the range of about 75–100 ml/min.

17. The carrier head of claim 13, wherein the polishing slurry is gravity fed into the trough at a rate in the range of about 75–100 ml/min.

18. The carrier head of claim 1, further including a tube connecting a passage in a carrier head drive shaft to the reservoir.

19. The carrier head of claim 13, further including an inwardly extending groove formed in the bottom surface of the retaining ring and fluidly coupled to the at least one channel.

20. A chemical mechanical polishing apparatus, comprising:

a polishing pad;

a carrier head including a substrate receiving surface, a retaining ring surrounding the substrate receiving surface, a trough on a top surface of the retaining ring, and at least one channel extending through the retaining ring to fluidly couple the trough to a bottom surface of the retaining ring to dispense a polishing slurry on a polishing pad; and an arm extending over the polishing pad to dispense a polishing slurry into the trough.

21. A chemical mechanical polishing apparatus, comprising:

a polishing pad;

a carrier head including a substrate receiving surface, a retaining ring surrounding the substrate receiving surface, a trough on a top surface of the retaining ring, and at least one channel to fluidly couple the trough to a bottom surface of the retaining ring to dispense a polishing slurry on a polishing pad; and an arm extending over the polishing pad to dispense a polishing slurry into the trough, wherein the arm is pivotally movable.

22. A method for a chemical mechanical polishing apparatus, comprising:

directing a polishing slurry through a passage in a retaining ring onto a polishing pad.

23. The method of claim 22, wherein the polishing slurry is metered into the trough at a rate in the range of about 75–100 ml/min.

24. A method of chemical mechanical polishing, comprising:

directing a polishing slurry from a reservoir through a passage in a retaining ring onto a polishing pad.

25. A chemical mechanical polishing apparatus, comprising:

a polishing pad;

a carrier head including a substrate receiving surface, a retaining ring surrounding the substrate receiving surface, a trough on a top surface of the carrier head, and at least one channel to fluidly couple the trough to a bottom surface of the retaining ring to dispense a polishing slurry on a polishing pad;

an arm extending over the polishing pad to dispense a polishing slurry into the reservoir;

a slurry pump to intermittently dispense the polishing slurry into the reservoir.

26. The apparatus of claim 25 wherein the pump dispenses sufficient slurry to polish a pre-selected number of substrates into the reservoir.

27. A chemical mechanical polishing apparatus, comprising:

a polishing pad;

a carrier head including a substrate receiving surface, a retaining ring surrounding the substrate receiving surface, a trough on a top surface of the retaining ring, and at least one channel to fluidly couple the trough to a bottom surface of the retaining ring to dispense a polishing slurry on a polishing pad;

an arm extending over the polishing pad to dispense a polishing slurry into the reservoir; and a slurry pump to intermittently dispense the polishing slurry into the reservoir, wherein the pump dispenses sufficient slurry to polish a pre-selected number of substrates into the reservoir and wherein the arm is pivotally connected to a machine base.

28. A method for a chemical mechanical polishing apparatus, comprising:

intermittently dispensing a polishing slurry into a reservoir formed on a carrier head; and directing the polishing slurry through a passage in the carrier head onto a polishing pad.

29. The method of claim 28, wherein slurry sufficient to polish a pre-selected number of substrates is dispensed into the reservoir.

30. A carrier head for a chemical mechanical polishing apparatus, comprising:

a substrate receiving surface;

a retaining ring surrounding the substrate receiving surface;

a slurry reservoir formed on the carrier head, the reservoir in fluid communication with a bottom surface of the retaining ring to direct a polishing slurry from the reservoir to a polishing pad; and a circular groove formed in the bottom surface of the retaining ring fluidly coupled to the reservoir.

* * * * *